US008668404B2

(12) United States Patent
Bouchard et al.

(10) Patent No.: US 8,668,404 B2
(45) Date of Patent: Mar. 11, 2014

(54) COVERING UNIT

(75) Inventors: Sebastien Bouchard, Montreal (CA); Marc-Andre Lacas, Laval (CA)

(73) Assignee: Oldcastle Building Products Canada, Inc. (CA)

( * ) Notice: Subject to any disclaimer, the term of this patent is extended or adjusted under 35 U.S.C. 154(b) by 0 days.

(21) Appl. No.: 13/494,922

(22) Filed: Jun. 12, 2012

(65) Prior Publication Data

US 2012/0247050 A1 Oct. 4, 2012

Related U.S. Application Data

(63) Continuation of application No. 12/680,284, filed as application No. PCT/CA2008/001656 on Sep. 18, 2008, now Pat. No. 8,226,323.

(60) Provisional application No. 60/960,351, filed on Sep. 26, 2007.

(51) Int. Cl.

| | |
|---|---|
| ***E01C 5/00*** | (2006.01) |
| ***E01C 5/06*** | (2006.01) |
| ***E04B 5/02*** | (2006.01) |

(52) U.S. Cl.

USPC ..... 404/41; 404/34; 52/604; 52/608; 52/609

(58) Field of Classification Search

USPC ..... 52/596, 604, 608, 609; 404/34, 41; D25/113

See application file for complete search history.

(56) References Cited

U.S. PATENT DOCUMENTS

| | | | |
|---|---|---|---|
| 653,515 | A | 7/1900 | Kennedy |
| 1,474,779 | A | 11/1923 | Zur Kammer |
| 1,479,647 | A | 1/1924 | Carroll |
| 1,600,787 | A | 9/1926 | Ardit |
| 1,953,657 | A | 4/1934 | Pierce |

(Continued)

FOREIGN PATENT DOCUMENTS

| | | |
|---|---|---|
| BE | 570711 | 11/1961 |
| CA | 1150553 | 7/1983 |

(Continued)

OTHER PUBLICATIONS

Notice of Allowance in related U.S. Appl. No. 13/367,117, dated Aug. 23, 2012, 11 pages.

(Continued)

*Primary Examiner* — Gary Hartmann

(74) *Attorney, Agent, or Firm* — Kilpatrick Townsend & Stockton LLP

(57) ABSTRACT

A covering unit for use in combination with similar units for covering a surface with a natural random look, the unit having an hexagonal body comprising first, second and third pairs of opposed and parallel sides. Each side has a central point of angular symmetry. The second and third pairs are similar to each other while the first pair is different from the others. The sides of the second and third pairs are provided with at least one split deviation along their length arranged so that each side of the second pair is a rotational image of the sides of the third pair, whereby in use in combination with other covering units: each side is matingly engageable with the sides of an equivalent pair of a neighboring unit; and the unit has a central point of angular symmetry and is matingly engageable with a plurality of neighboring unit.

20 Claims, 7 Drawing Sheets

(56) References Cited

U.S. PATENT DOCUMENTS

| | | | |
|---|---|---|---|
| 2,050,299 | A | 8/1936 | Evers |
| 2,605,681 | A | 8/1952 | Thrief |
| 2,606,428 | A | 8/1952 | Oldfather |
| 2,893,098 | A | 7/1959 | Tilley |
| 2,991,213 | A | 7/1961 | Williams |
| 3,171,335 | A | 3/1965 | Pincon et al. |
| D204,803 | S | 5/1966 | Leeth |
| 3,267,823 | A | 8/1966 | MacRae |
| 3,386,001 | A | 5/1968 | Slosberg et al. |
| 3,600,773 | A | 8/1971 | Davis et al. |
| D230,478 | S | 2/1974 | Littman et al. |
| D231,926 | S | 6/1974 | Appleton |
| 3,870,423 | A | 3/1975 | Peitz, Jr. |
| 3,947,192 | A | 3/1976 | Rosenberger |
| 4,026,083 | A | 5/1977 | Hoyt et al. |
| 4,078,760 | A | 3/1978 | Mullins |
| 4,105,354 | A | 8/1978 | Bowman |
| 4,125,341 | A | 11/1978 | Reinschutz |
| 4,131,406 | A | 12/1978 | Fresquez |
| 4,135,840 | A | 1/1979 | Puccini et al. |
| 4,217,740 | A | 8/1980 | Assanti |
| 4,231,677 | A | 11/1980 | Roming |
| D257,824 | S | 1/1981 | Puccini et al. |
| D257,825 | S | 1/1981 | Puccini et al. |
| 4,287,141 | A | 9/1981 | Russell |
| 4,313,689 | A | 2/1982 | Reinschutz |
| 4,349,293 | A | 9/1982 | Rosenberger |
| 4,354,773 | A | 10/1982 | Noack |
| 4,407,480 | A | 10/1983 | Trimmer et al. |
| D272,037 | S | 1/1984 | Puccini |
| 4,452,419 | A | 6/1984 | Saleeba |
| 4,510,725 | A | 4/1985 | Wilson |
| 4,544,305 | A | 10/1985 | Hair |
| D281,505 | S | 11/1985 | Larsen et al. |
| 4,609,303 | A | 9/1986 | Shumaker |
| 4,627,764 | A | 12/1986 | Scheiwiller |
| 4,773,790 | A | 9/1988 | Hagenah |
| 4,776,723 | A | 10/1988 | Brimo |
| 4,792,257 | A | 12/1988 | Rinninger |
| 4,828,426 | A | 5/1989 | Hendricks et al. |
| 4,838,728 | A | 6/1989 | McKeever |
| 4,919,565 | A | 4/1990 | Göpfert |
| 4,921,372 | A | 5/1990 | Hybertson |
| D314,240 | S | 1/1991 | Scheiwiller |
| 5,051,023 | A | 9/1991 | Yoshida et al. |
| 5,108,219 | A | 4/1992 | Hair |
| 5,133,620 | A | 7/1992 | Scheiwiller |
| 5,201,843 | A | 4/1993 | Hair |
| 5,211,895 | A | 5/1993 | Jacklich, Sr. |
| 5,230,584 | A | 7/1993 | Grossman |
| 5,244,303 | A | 9/1993 | Hair |
| D342,528 | S | 12/1993 | Hupp |
| 5,267,810 | A | 12/1993 | Johnson |
| D343,237 | S | 1/1994 | Johnson, II |
| D343,238 | S | 1/1994 | Hair |
| 5,277,514 | A | 1/1994 | Glickman |
| 5,281,047 | A | 1/1994 | Skaug |
| 5,286,139 | A | 2/1994 | Hair |
| D349,967 | S | 8/1994 | Krueger et al. |
| 5,342,142 | A | 8/1994 | Barth et al. |
| 5,348,417 | A | 9/1994 | Scheiwiller |
| 5,486,066 | A | 1/1996 | Hagenah |
| 5,487,526 | A | 1/1996 | Hupp |
| 5,496,129 | A | 3/1996 | Dube |
| 5,524,396 | A | 6/1996 | Lalvani |
| 5,568,391 | A | 10/1996 | Mckee |
| 5,588,775 | A | 12/1996 | Hagenah |
| 5,597,591 | A | 1/1997 | Hagenah |
| 5,619,830 | A | 4/1997 | Osborn |
| 5,625,990 | A | 5/1997 | Hazlett |
| 5,713,155 | A | 2/1998 | Prestele |
| 5,797,698 | A | 8/1998 | Barth et al. |
| D397,802 | S | 9/1998 | Terry |
| D399,978 | S | 10/1998 | Barth et al. |
| D404,147 | S | 1/1999 | Woolford |
| 5,884,445 | A | 3/1999 | Woolford |
| 5,902,069 | A | 5/1999 | Barth et al. |
| 5,921,705 | A | 7/1999 | Hodson et al. |
| 5,945,181 | A | 8/1999 | Fisher |
| D424,212 | S | 5/2000 | Abbrancati |
| D426,897 | S | 6/2000 | Abbracati |
| D429,343 | S | 8/2000 | Milot |
| D429,530 | S | 8/2000 | Fleishman |
| D431,870 | S | 10/2000 | Ziegler, Jr. |
| D431,871 | S | 10/2000 | Abbrancati |
| 6,168,347 | B1 | 1/2001 | Milot et al. |
| D439,677 | S | 3/2001 | Mattox |
| 6,263,633 | B1 | 7/2001 | Hagenah |
| D452,015 | S | 12/2001 | Aurelius |
| RE37,694 | E | 5/2002 | Riccobene |
| D463,866 | S | 10/2002 | Jang |
| 6,471,440 | B1 | 10/2002 | Scheiwiller |
| D471,990 | S | 3/2003 | Riccobene |
| 6,536,988 | B2 | 3/2003 | Geiger |
| D480,819 | S | 10/2003 | Barbier |
| 6,668,484 | B2 | 12/2003 | Riccobene |
| D488,566 | S | 4/2004 | Fleishman |
| 6,715,956 | B1 | 4/2004 | Weber et al. |
| D492,796 | S | 7/2004 | Price |
| 6,881,463 | B2 | 4/2005 | Riccobene |
| D505,733 | S | 5/2005 | Castonguay et al. |
| D506,013 | S | 6/2005 | Anderson et al. |
| D522,667 | S | 6/2006 | Castonguay et al. |
| D536,058 | S | 1/2007 | Riccobene |
| D537,501 | S | 2/2007 | Riccobene |
| D537,959 | S | 3/2007 | Castonguay et al. |
| D540,954 | S | 4/2007 | Bouchard |
| D543,642 | S | 5/2007 | Castonguay et al. |
| D550,375 | S | 9/2007 | Thomassen et al. |
| D553,260 | S | 10/2007 | Castonguay et al. |
| D553,759 | S | 10/2007 | Hamel |
| 7,393,155 | B2 | 7/2008 | Riccobene |
| 7,425,106 | B2 | 9/2008 | Altmann et al. |
| D578,658 | S | 10/2008 | Keys |
| D586,925 | S | 2/2009 | Riccobene |
| D590,070 | S | 4/2009 | Castonguay et al. |
| D590,071 | S | 4/2009 | Castonguay et al. |
| D590,072 | S | 4/2009 | Castonguay et al. |
| D606,210 | S | 12/2009 | Thomassen |
| 7,637,688 | B2 | 12/2009 | Riccobene |
| 7,674,067 | B2 | 3/2010 | Riccobene |
| D618,364 | S | 6/2010 | Schrom et al. |
| D620,616 | S | 7/2010 | Ciccarello |
| D624,202 | S | 9/2010 | Thomassen et al. |
| D624,203 | S | 9/2010 | Thomassen et al. |
| 7,850,393 | B2 | 12/2010 | Hamel |
| 7,988,382 | B2 | 8/2011 | Castonguay et al. |
| 7,993,718 | B2 | 8/2011 | Riccobene |
| 8,132,981 | B2 | 3/2012 | Castonguay et al. |
| D664,677 | S | 7/2012 | Riccobene |
| 8,226,323 | B2 * | 7/2012 | Bouchard et al. ..... 404/41 |
| 8,298,641 | B2 | 10/2012 | Riccobene |
| 8,337,116 | B2 | 12/2012 | Castonguay et al. |
| 8,500,361 | B2 | 8/2013 | Castonguay et al. |
| D695,915 | S | 12/2013 | Dignard et al. |
| D695,916 | S | 12/2013 | Dignard et al. |
| D695,917 | S | 12/2013 | Dignard et al. |
| D695,918 | S | 12/2013 | Dignard et al. |
| D695,919 | S | 12/2013 | Dignard et al. |
| D695,920 | S | 12/2013 | Dignard |
| D695,921 | S | 12/2013 | Dignard |
| D695,922 | S | 12/2013 | Dignard |
| 2003/0007834 | A1 | 1/2003 | Bolduc et al. |
| 2007/0077387 | A1 | 4/2007 | Riccobene |
| 2007/0217865 | A1 | 9/2007 | Castonguay et al. |
| 2008/0095577 | A1 | 4/2008 | Brun |
| 2008/0209828 | A1 | 9/2008 | Riccobene |
| 2008/0240857 | A1 | 10/2008 | Ciccarello |
| 2010/0236174 | A1 | 9/2010 | Castonguay et al. |
| 2010/0307092 | A1 | 12/2010 | Bouchard et al. |
| 2011/0067333 | A1 | 3/2011 | Lacas et al. |
| 2012/0003040 | A1 | 1/2012 | Castonguay et al. |

(56) References Cited

U.S. PATENT DOCUMENTS

| | | | | |
|---|---|---|---|---|
| 2012/0189386 | A1 | 7/2012 | Castonguay et al. | |
| 2013/0017016 | A1 | 1/2013 | Castonguay et al. | |
| 2013/0259569 | A1* | 10/2013 | Castonguay et al. | 404/41 |

FOREIGN PATENT DOCUMENTS

| | | |
|---|---|---|
| CA | 2083215 | 5/1994 |
| CA | 2519296 | 10/2004 |
| CA | 2569998 | 5/2006 |
| CA | 2616200 | 4/2008 |
| CH | 562921 | 6/1975 |
| DE | 7122262 | 11/1971 |
| DE | 3533020 | 3/1987 |
| DE | 9211118 | 3/1993 |
| DE | 4232300 | 3/1994 |
| DE | 4333942 | 4/1995 |
| DE | 19747421 | 4/1999 |
| DE | 29922003 | 2/2000 |
| DE | 10001967 | 7/2001 |
| DE | 20101214 | 5/2002 |
| FR | 2354416 | 1/1978 |
| GB | 1047163 | 12/1987 |
| GB | D. 1047163 | 12/1987 |
| GB | 2208883 | 4/1989 |
| GB | 2214206 | 8/1989 |
| JP | 2002/285504 | 10/2002 |
| JP | 1180760 | 6/2003 |
| JP | 1180761 | 6/2003 |
| JP | 1180860 | 6/2003 |
| JP | 1180861 | 6/2003 |
| JP | 2004-124634 | 4/2004 |
| JP | 3640654 | 1/2005 |
| NL | 7415523 | 6/1976 |
| SE | 44357 | 10/1988 |
| SE | D. 44357 | 10/1988 |
| WO | WO9415025 | 7/1994 |
| WO | WO0144578 | 6/2001 |
| WO | 01/53612 | 7/2001 |
| WO | WO02059423 | 8/2002 |
| WO | 02/89934 | 11/2002 |
| WO | WO02095133 | 11/2002 |
| WO | WO2005084900 | 9/2005 |
| WO | WO2006045192 | 5/2006 |
| WO | WO2009039617 | 4/2009 |
| WO | WO2009140760 | 11/2009 |

OTHER PUBLICATIONS

Non Final Office Action in related U.S. Appl. No. 13/619,606, dated Nov. 8, 2012, 11 pages.
Amendment and Response to Office Action in related U.S. Appl. No. 12/993,526, dated Oct. 23, 2012, 18 pages.
Notice of Allowance in related U.S. Appl. No. 12/993,526, dated Dec. 11, 2012, 9 pages.
Lawrence, Backyard Brickwork, 1989, p. 76, Garden Way Publishing, Pownal, VT, U.S.A.
Fitzgerrell, Basic Masonry Illustrated, a Sunset Book, 1981, pp. 76-77, Lane Publishing Co., Menlo Park, CA, U.S.A.
Bomanite Corp.-Leadership A Reputation for Excellence, Innovation & Experience, 1994, Bomanite International Society, Madera, CA, U.S.A.
Brickform Patterns—1 Sheet, 1994.
Brickform Texture Mats—2 Sheets, 1988.
Brickform Tools—Texture Mats—4 Sheets, Undated.
Color Tile Advertisement, Royal Rock Ceramic Tile, Jan. 14, 1990, Houston Post, Houston, TX, U.S.A.
Creative Impressions, Ltd., Export Price List and Drawings, Apr. 1990, U.K.
Exhibit G—Photocopy of Front of Color Tile Royal Rock Ceramic Tile, Undated.
Exhibit H—Photocopy of Rear of Color Tile Royal Rock Ceramic Tile, Undated.
Decristoforo, Handyman's Guide to Concrete and Masonry, 1978, pp. 183-189, Reston Publishing Co., Inc., Reston, VA, U.S.A.
Decristoforo, Handyman's Guide to Concrete and Masonry Handbook, 1960, p. 70, Arco Publishing Co., Inc., New York City, NY, U.S.A.
Lasting Impressions in Concrete, Inc., Undated, CA, U.S.A.
Patterned Concrete Industries, Inc., Specifications, Undated, Houston, TX, U.S.A.
Sweet's Catalog, vol. 2 Bomacron Patterns, 1994.
Sweets General Building and Renovation, 1993 Catalog File, p. 11, Anchor Buyline 6518, 04200/ANC.
Duncan, The Complete Book of Outdoor Masonry, 1977, pp. 342-345, Tab Books, Blue Ridge Summit, PA, U.S.A.
Uni-Group U.S.A.—Manufacture of Uni Paving Stones The Original. The Best., 1992, Palm Beach Gardens, FL, U.S.A.
Extended European Search Report dated Apr. 18, 2011 in related Application No. 05799111.9.
Written Opinion dated Feb. 2, 2006 in related Application No. PCT/CA2005/001644.
Written Opinion dated Dec. 15, 2008 in related Application No. PCT/CA2008/001656.
Written Opinion dated Sep. 8, 2009 in related Application No. PCT/CA2009/000688.
"U.S. Appl. No. 11/573,142, Non Final Office Action", mailed Sep. 23, 2009.
"U.S. Appl. No. 12/729,909, Non Final Office Action", mailed Aug. 6, 2010.
"U.S. Appl. No. 12/729,909, Response to Non Final Office Action", filed Feb. 7, 2011.
"U.S. Appl. No. 12/729,909, Notice of Allowance", mailed Mar. 24, 2011.
"U.S. Appl. No. 13/167,053, Notice of Allowance", mailed Nov. 4, 2011.
"U.S. Appl. No. 13/367,117, Ex Parte Quayle Action", mailed May 24, 2012.
"U.S. Appl. No. 12/993,526, Non Final Office Action", mailed May 24, 2012.
"U.S. Appl. No. 12/680,284, Non Final Office Action", mailed Oct. 5, 2011.
"U.S. Appl. No. 12/680,284, Response", mailed Feb. 6, 2012.
"U.S. Appl. No. 12/680,284, Notice of Allowance", mailed Mar. 12, 2012.
"U.S. Appl. No. 29/250,971, Non Final Office Action", mailed Dec. 10, 2008.
"U.S. Appl. No. 29/250,971, Response to Restriction Requirement", filed Jan. 12, 2009.
"U.S. Appl. No. 29/250,971, Non Final Office Action", mailed Mar. 5, 2009.
"U.S. Appl. No. 29/250,971, Response to Non Final Office Action", filed Jun. 3, 2009.
"U.S. Appl. No. 29/250,971, Final Office Action", mailed Jul. 21, 2009.
"U.S. Appl. No. 29/250,971, Preliminary Amendment", filed Dec. 18, 2009.
"U.S. Appl. No. 29/250,971, Final Office Action", mailed Mar. 2, 2010.
"U.S. Appl. No. 29/250,971, Response After Final Office Action", filed May 3, 2010.
"U.S. Appl. No. 29/250,971, Notice of Allowance", mailed May 24, 2010.
"U.S. Appl. No. 29/338,035, Non Final Office Action", mailed Feb. 3, 2010.
"U.S. Appl. No. 29/338,035, Response to Office Action", filed May 3, 2010.
"U.S. Appl. No. 29/338,035, Notice of Allowance", mailed May 24, 2010.
Response to Ex Parte Quayle Action in related U.S. Appl. No. 13/619,606, dated Feb. 8, 2013, 10 pages.
Notice of Allowance in related U.S. Appl. No. 13/619,606, dated Feb. 25, 2013, 6 pages.
U.S. Appl. No. 29/431,253, Sep. 5, 2012, Dignard.
U.S. Appl. No. 29/431,251, Sep. 5, 2012, Dignard.
U.S. Appl. No. 29/431,248, Sep. 5, 2012, Dignard.

(56) References Cited

OTHER PUBLICATIONS

U.S. Appl. No. 26/431,257, Sep. 5, 2012, Dignard.
U.S. Appl. No. 29/431,244, Sep. 5, 2012, Dignard.
U.S. Appl. No. 26/431,264, Sep. 5, 2012, Dignard.
U.S. Appl. No. 29/431,269, Sep. 5, 2012, Dignard.
U.S. Appl. No. 29/431,260, Sep. 5, 2012, Dignard.
Response in related U.S. Appl. No. 12/993,526, dated Oct. 23, 2012, 18 pages.
Grunbaum, B. and Shephard, G.C., "Tilings and Patterns," 1987, pp. 288-290, 510 W.H. Freeman and Company, New York, N.Y.
"Landscapes Become Dreamscapes," Pavestone Company, 2003, 2 pages.
Neolithics Masonry Design, www.neolithicsusa.com, Nov. 2003, 3 pages.
Author: Jinny Beyer, Designing Tessellatins: The Secrets of Interlocking Patterns, Chapter 7: The Keys to creating Interlocking Tessellations: pp. 1-7, 16-17 and 125-165, 1999.
Nature Walk™ Natural Flagstone Appeal for Pedestrian Traffic, 2001, 4 pages.
Website: www.sf-kooperation.de/english/index—Pentalith, Canteon, Jul. 2001, 3 pages.
Website:www.sf-kooperation.de/english/index—Canteon®; CIS 300-10; Pentalith, Sep. 2003, 5 pages.
Retaining Walls, Pavestone Brochure, published 2002, 6 pages.
Concrete Landscaping/Products, Oldcastle Brochure, published 2002, 12 pages.
Website: www.mathforum.org/sum95/suzanne/whattess.html—What is Tessellation?—dated Apr. 24, 2002, 4 pages.
Beautiful Edgers, Pavestone Brochure, published 2002, 5 pages.
Website: www.superstone.com—Split Rock, Dec. 2002, 1 page.
Website: www.matcrete.net/RandomStone.htm—MATCRETE The Ultimate in Concrete Design, Dec. 2002, 1 page.
Patio Dreamscapes, Pavestone Brochure; Sandstone System, published 2003, 5 pages.
Landscaping Stones, Mat Stone Brochure, Nature Walk, Garden Walk, published 2003, 2 pages.
Paving Stone Dreamscapes, Pavestone Brochure, published 2003, 13 pages.
Website: www.geckostone.com—GECKOSTONE™ , Mar. 2003, 4 pages.
Website: www.learningcompanyschool.com—TesselMania! Deluxe, Jun. 2003, 3 pages.
Website: riverdeep.net/products/other/tesselmania.jhtml—TesselMania!, Jun. 2003, 4 pages.

* cited by examiner

COVERING UNIT

CROSS REFERENCE TO RELATED APPLICATIONS

This application is a continuation of U.S. application Ser. No. 12/680,284 filed Mar. 26, 2010, which is a U.S. national phase patent application under 35 U.S.C. 371 of International Patent Application No. PCT/CA2008/001656 filed Sep. 18, 2008, which claims the benefit of U.S. Provisional Application No. 60/960,351 filed Sep. 26, 2007. The contents of all are incorporated herein by this reference.

FIELD OF THE INVENTION

The present invention relates generally to the field of artificial covering units, stones or flagstones for laying out pavements or for covering a wall surface, and is more particularly directed to such covering units giving the resulting pavement or wall surface an improved natural-looking appearance while being still easy to install.

BACKGROUND OF THE INVENTION

It is worth mentioning that the expressions "artificial covering units", "stone" and "flagstone" are used throughout the present description without distinction to define a flat slab of stone used as a paving or building material. Artificial covering units or artificial stones, which are generally made of concrete, are well-known to lay out pavements or covering wall surfaces on residential or commercial properties, for example for defining the surface of walkways or patios. Such artificial covering units are advantageously relatively inexpensive to manufacture, as opposed to natural carved flagstones, but the resulting pattern is often repetitive or has what is called in this field an unnatural "linear line effect". Great efforts are therefore being made to design artificial stones which provide a more natural look, creating the effect of old world craftsmanship, while still retaining the ease of their manufacture.

One example of a prior art artificial flagstone is the flagstone marketed under the trademark Kusel-Form. One drawback however with that prior art flagstone, which is provided with regular segments, is that it still does not provide a satisfactory old natural look. It still looks artificial.

Other attempts have been made in the past to develop sets of artificial stones comprising stones of different shapes used in combination with each other for paving a surface. The natural random look in those cases is obtained by combining artificial stones of different shapes. A major drawback however with those sets is that it often becomes a real puzzle for a user to install and combine those stones in a proper way.

Known to the Applicant are U.S. Pat. No. 6,881,463 and US2006/0182923, and US applications 2007/0077387 and 2007/0098945, all from RICCOBENE.

U.S. Pat. No. 6,881,463 concerns a surface covering unit comprising primary units which are rotational tessellation of one another. US2006/0182923 concerns a building unit having three vertices and a pair of sides extending from each vertex, the sides of a pair being rotational images of each other. US application 2007/0077387 discloses a building unit resembling the one from US2006/0182923 for which two of its sides may have a midpoint bisecting the sides in two portions, each portion being a rotational image of the other portion. US application 2007/0098945 is a republication of US application 2006/0182923. This republished application discloses sides of the building unit which all comprise a series of straight-line segments, the segment being angled relative to at least one adjacent segment such that the general appearance of the sides is irregular.

Also known to the Application is Japanese patent P2004-124634 (IDO). This patent concerns a block having pairs of neighbouring sides, the first side of a pair having a shape which is a "negative" image of the shape of the other side of the pair. The sides of such pair are also provided with indicators (or index) that facilitate the matching of adjacent blocks during their installation.

In Canadian patent No. 2,569,998, the Applicant of the present invention improved over the prior art artificial stones in providing an asymmetrical artificial flagstone having six irregular sides. Indeed, the split deviations provided on the sides provide an irregular profile that gives the flagstone a more natural look. This artificial flagstone is particularly advantageous since it makes it possible to obtain a pavement with an improved natural random look by simply using a plurality of artificial flagstones having all the same shape. In order to guide the user during the laying out of the stones on a surface, the stones may be provided with distinctive markers thereon.

Even if the above-described flagstones proposed by the Applicant of the present invention are satisfactory, there is still a need for an improved artificial covering unit that would provide a surface with an even improved natural random look, while, at the same time, being easy to manufacture at a reasonable cost and easy to install for any unskilled person.

SUMMARY OF THE INVENTION

An object of the present invention is to provide an artificial covering unit that satisfies the above-mentioned need.

Accordingly, there is provided a covering unit for use in combination with other ones of the covering units for covering a surface, the covering unit having a generally hexagonal body comprising:

- a first, a second and a third pair of opposed and substantially parallel sides for defining the generally hexagonal body;

wherein:

- each of the sides of each of the pairs has a central point of angular symmetry;
- the second and third pairs of sides are substantially similar to each other while the first pair of sides is substantially different from the second and third pairs of sides; and
- the sides of the second and third pairs are provided with at least one split deviation along their length arranged so that each side of the second pair is a rotational image of the sides of the third pair, whereby in use in combination with the other covering units:
- each one of the sides is matingly engageable with the sides of an equivalent pair of sides of a neighbouring covering unit; and
- the covering unit has a central point of angular symmetry and is matingly engageable with a plurality of neighbouring covering unit in either a similar orientation or in an orientation of 180°.

The sides of the first pair can be longer from the sides of the second and third pairs, and may also be provided with at least one split deviation along their length arranged so that each side of the first pair is a rotational image of the other one.

The split deviations provided on the sides of the covering unit advantageously make it possible to obtain a pavement with a natural random look by simply using a plurality of similar artificial covering units. Moreover, the particular shape of the covering unit which advantageously allows a lay out of the unit with the others in two opposite orientations on an individual basis improves even more the random look of the pavement while greatly facilitating the installation of the units.

The present invention is also very advantageous for a manufacturer, since the production of the artificial covering units requires only a single shape for the mould used for moulding the covering units.

Further aspects and advantages of the present invention will be better understood upon reading of preferred embodiments thereof with respect to the appended drawings.

Figure 1:
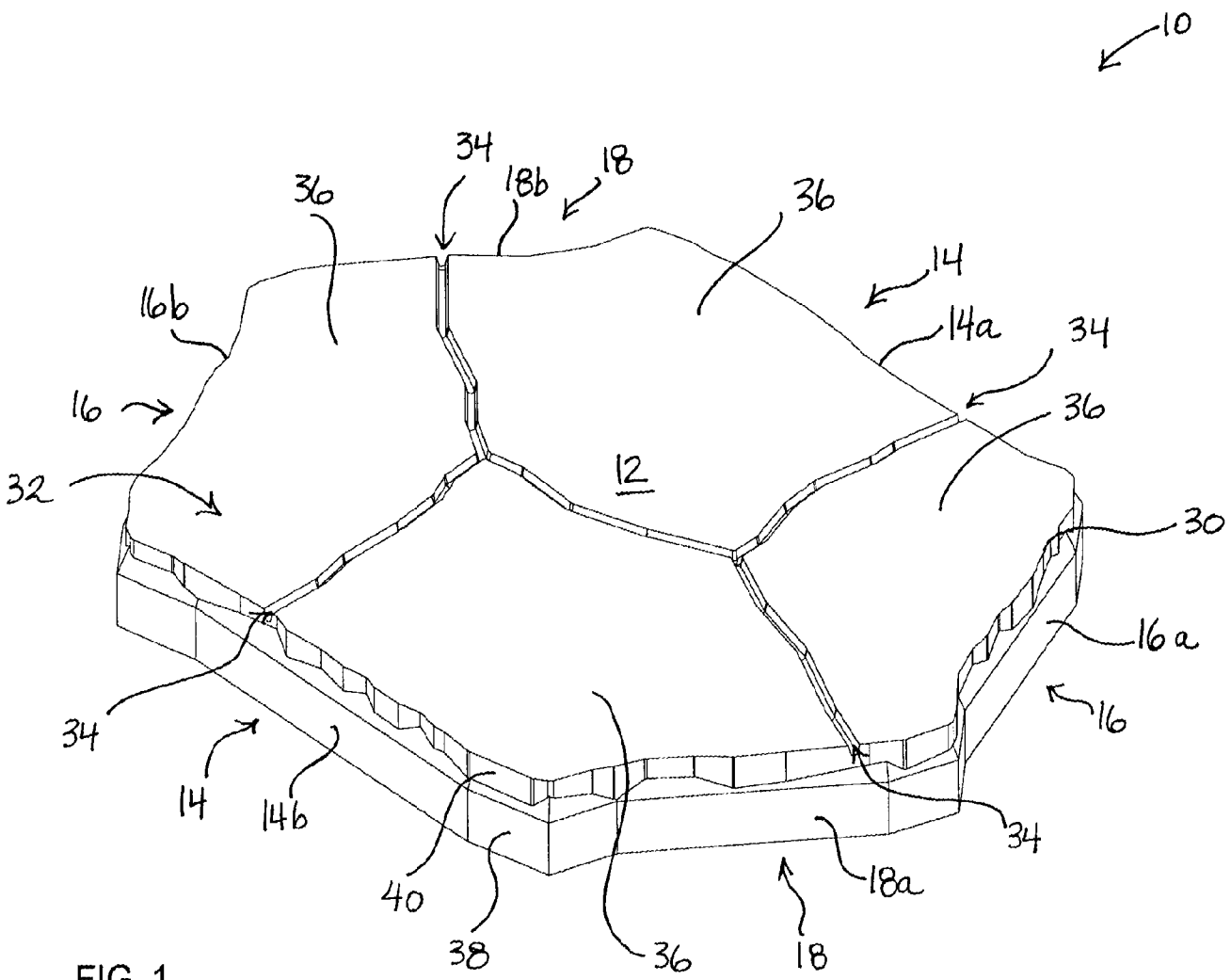
FIG. 1 is a perspective view of a covering unit according to a first preferred embodiment of the present invention.

While the invention will be described in conjunction with example embodiments, it will be understood that it is not intended to limit the scope of the invention to such embodiments. On the contrary, it is intended to cover all alternatives, modifications and equivalents as may be included as defined by the present description and appended claims.

DESCRIPTION OF PREFERRED EMBODIMENTS OF THE INVENTION

In the following description, similar features in the drawings have been given similar reference numerals and in order to lighten the figures, some elements are not referred to in some figures if they were already identified in a preceding figure.

It is worth mentioning that throughout the present description, the expression "covering unit" is intended to mean any stone, flagstone or flat slab of stone used as a paving or building material. Although the present invention was primarily designed for concrete covering unit, it may also apply to other applications, such as with natural stones, hand or machine cut.

Referring to FIGS. 1 and 3A to 3E, the outline of a covering unit 10 according to the present invention is illustrated. The covering unit 10 has a generally hexagonal body 12 with a first, a second and a third pair of opposed and substantially parallel sides. The first pair of sides 14 comprises sides 14*a* and 14*b*, the second pair 16 comprises sides 16*a* and 16*b* while the third pair 18 comprises sides 18*a* and 18*b*. As better seen in FIG. 3A, each of the sides of each of the pairs 14, 16, 18 has a central point C of angular symmetry. More particularly, the portion of the side 14*a* extending on the right of point C, when rotated 180° around point C on the left portion of side 14*a*, is similar to this left portion. Each side 14*a*, 14*b*, 16*a*, 16*b*, 18*a*, 18*b* is built according to this concept. The second and third pairs 16, 18 of sides are substantially similar to each other, the sides 16*a*, 16*b*, 18*a*, 18*b* all having the same length and the same shape. As shown, the side 18*a* can be seen as a translation of side 18*b*, while being a rotational image of each of the sides 16*a* and 16*b*. As illustrated, the first pair 14 of sides 14*a*, 14*b* is substantially different from the second and third pairs 16, 18 of sides. Indeed, the sides of the first pair 14 preferably have a length substantially longer than a length of the sides of the second and third pairs 16, 18. Of course, a first pair 14 of sides shorter or of the same length than the sides of the second and third pairs 16, 18 is also within the scope of the present invention.

Figures 3A, 3B, 3C, 3D, 3E:
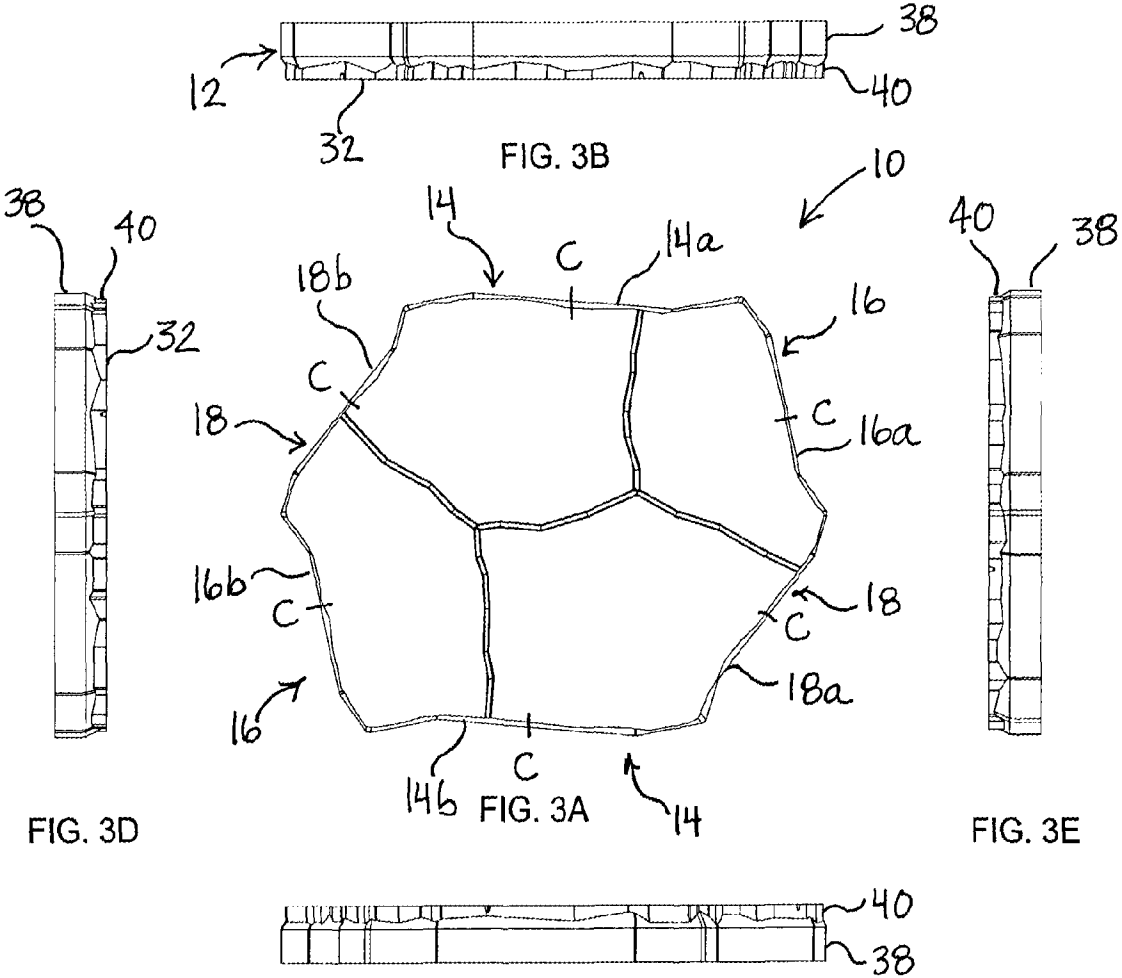
FIGS. 3A, 3B, 3C, 3D and 3E are respectively a top view, a first side view, a second side view, a third side view and a fourth side view of the covering unit of FIG. 1.
Figure 3F:
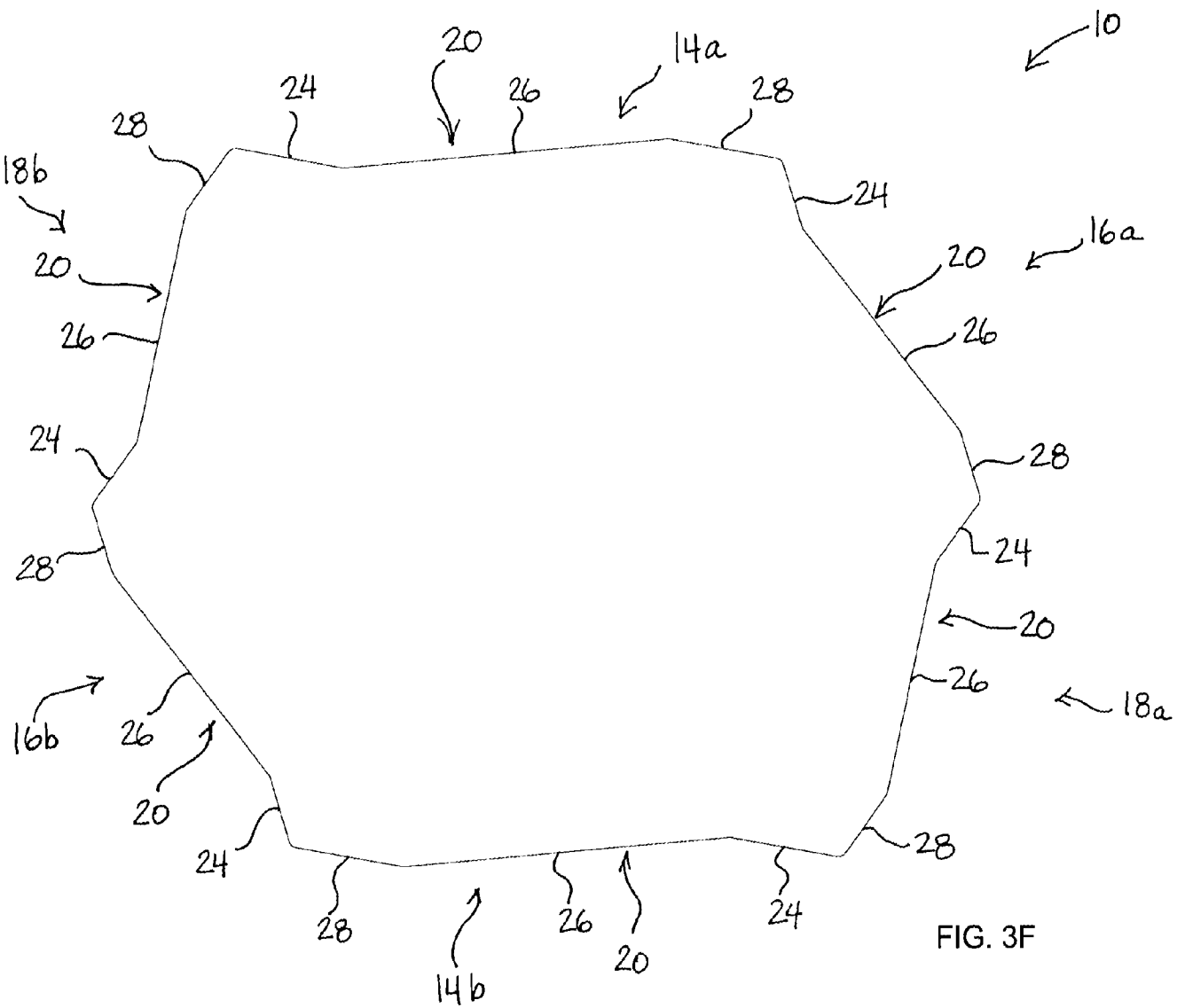
FIG. 3F is a bottom view of the covering unit of FIG. 1.

As better shown in FIG. 3F, in a preferred embodiment, the sides 16*a*, 16*b*, 18*a*, 18*b* of the second and third pairs 16, 18 are provided with at least one split deviation 20 along their length arranged so that each side 16*a*, 16*b* of the second pair 16 is a rotational image of the sides 18*a*, 18*b* of the third pair 18. As illustrated, split deviations 20 are segments dividing the corresponding sides in three portions 24, 26, 28 projecting outwardly and inwardly with respect to the body 12 of the covering unit 10. More particularly, each of the sides 16*a*, 16*b*, 18*a*, 18*b* of the second and third pairs 16, 18 has a specific shape along its length which is formed of three end-to-end portions: a first ending portion 24, followed by the split deviation 20, which comprises a generally straight segment 26, and a second ending portion 28 similar to the first ending portion 24. Preferably, each ending portion 24, 28 is a substantially straight segment. While conserving this general profile, the sides can however be slightly irregular, to give the covering unit 10 a more natural looking aspect. In the illustrated embodiment, the generally straight segment 26 is much longer than the ending portions 24, 28 but it should be mentioned that other arrangements are also possible. For example the arrangement of split deviations described in U.S. Ser. No. 11/573,142 in the name of the applicant, the disclosure of which is incorporated herein, can be used. Of course, the sides 16*a*, 16*b*, 18*a*, 18*b* may be each provided with several split deviations, as long as each side of the second pair is a rotational image of the sides of the third pair.

By split deviation, one could also understand a break in a segment which causes the same to deviate of a certain angle from its original line. A split deviation may be a segment, such as illustrated in FIG. 3F, where the split deviation 20 corresponds to segment 26, and breaks the side into three portions, 24, 26 and 28, but it could also be a point breaking a line into two segments.

Figure 2:
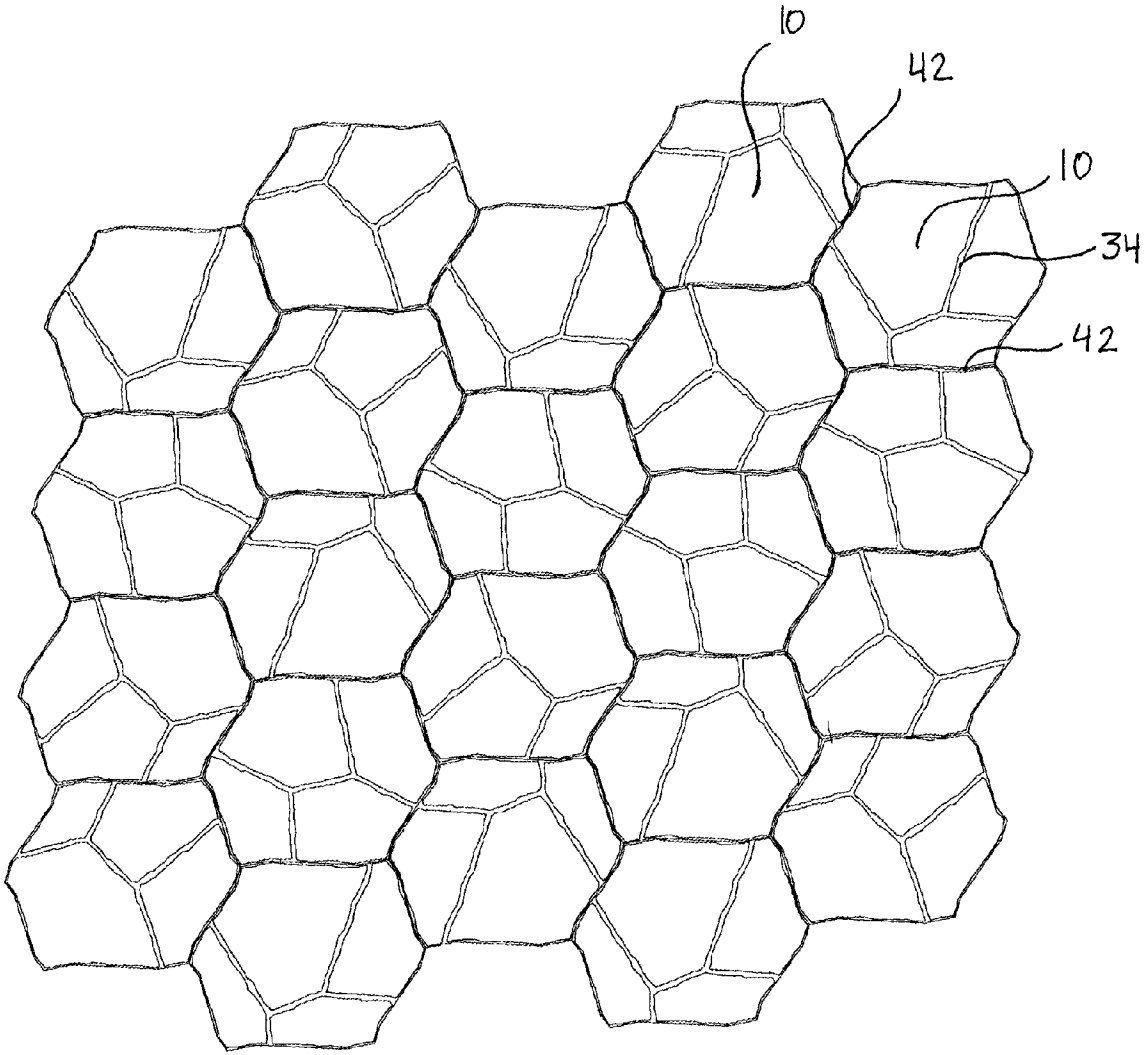
FIG. 2 is a perspective view of a plurality of covering units arranged together to form a pavement having a natural random look, according to a second preferred embodiment of the present invention.
Figure 4:
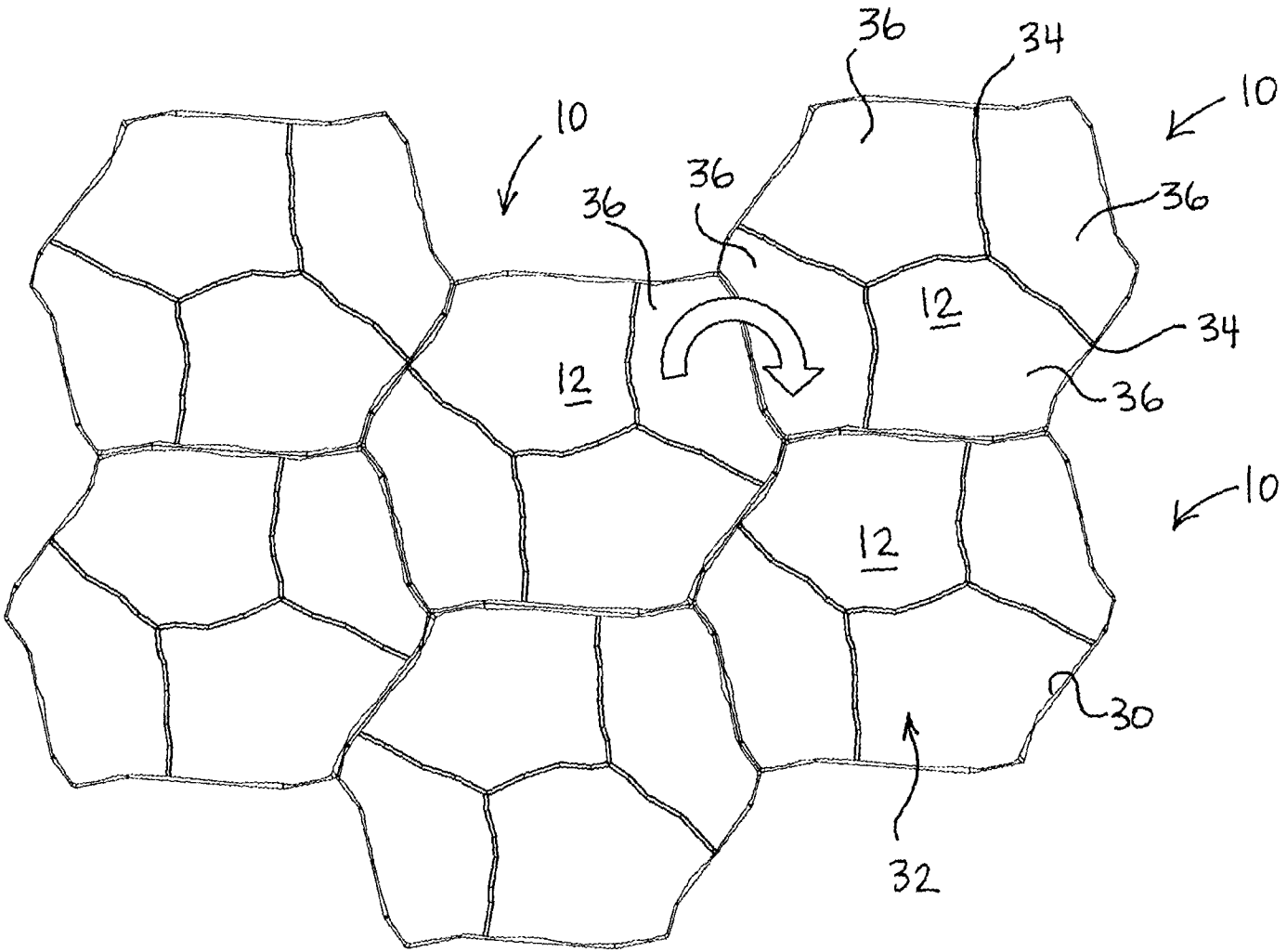
FIG. 4 is a top view of a plurality of covering units similar to the one illustrated in FIG. 1, arranged together to form a pavement, the covering units being arranged in two different orientations to improve the natural random look of the pavement.
Figure 5:
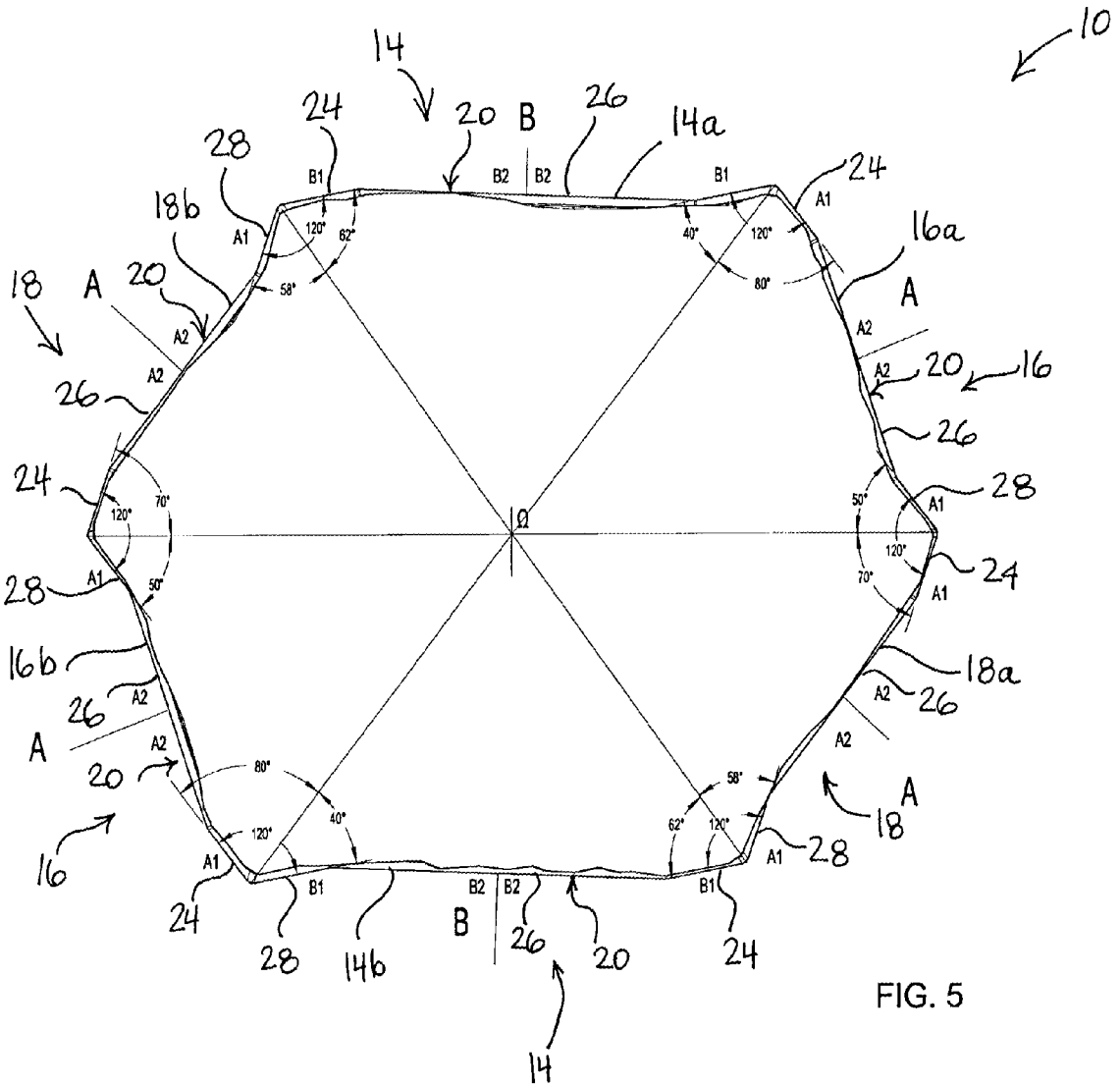
FIG. 5 is a schematic top view of an covering unit according to a further embodiment of the present invention.
Figures 6A, 6B, 6C, 6D, 6E, 6F:
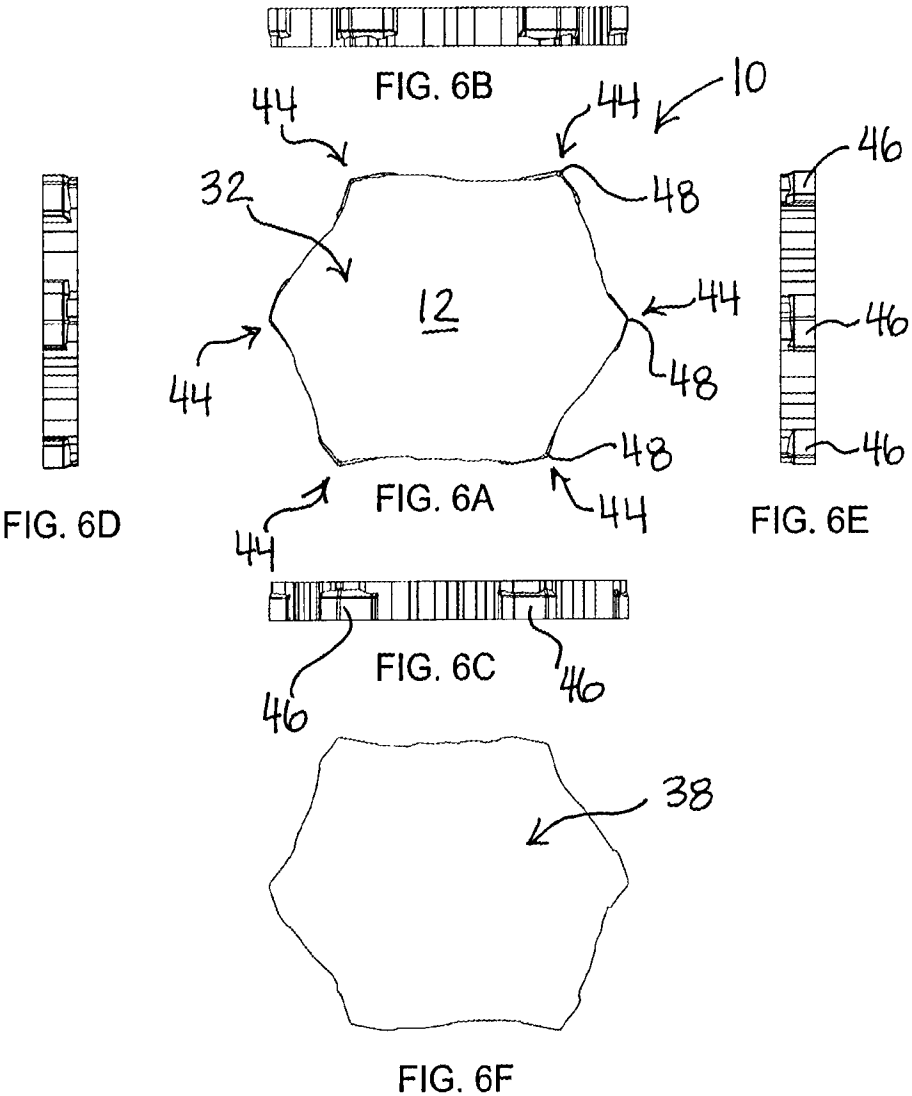
FIGS. 6A, 6B, 6C, 6D, 6E and 6F are respectively a top view, a first side view, a second side view, a third side view, a fourth side view and a bottom view of another covering unit according to the present invention.

As shown in FIGS. 2 and 4, thanks to its particular configuration, when a covering unit 10 according to the invention is used in combination with other ones for defining a wall or floor surface, each one of the sides 14*a*, 14*b*, 16*a*, 16*b*, 18*a*, 18*b* is matingly engageable with the corresponding side of an equivalent pair of sides of a neighbouring covering unit 10. Moreover, with this particular configuration, the covering unit 10 has a central point of angular symmetry Ω, as best shown in FIG. 5, and is matingly engageable with a plurality of neighbouring covering units 10 in either a similar orientation or in an orientation of 180°. For example, the longest side B of the covering unit 10 can be rotated around the central point of angular symmetry Ω to then correspond to the opposite side B'. As it will be more apparent upon the following description, this two-orientation configuration on an individual basis is particularly advantageous since it improves even more the random look of the wall surface. As shown, the covering unit 10 is engageable with the neighbouring covering units 10 in staggered rows or in other words arranged in quincunx, that is to say an arrangement of five units with one at each corner of a rectangle and one at the center.

Referring now to FIG. 5, in a preferred embodiment of the invention, the sides 14*a*, 14*b* of the first pair 14 are also provided with at least one split deviation 20 along their length arranged so that each side of the first pair 14 is a rotational image of the other side. Of course, as explained above with respect to the sides 16*a*, 16*b*, 18*a*, 18*b*, several split deviations could be considered. In this embodiment, as for the sides of the second and third pairs 16, 18, the sides of the first pair 14 have along their length a first ending portion 24, followed by the split deviation 20, which comprises a generally straight segment 26, and a second ending portion 28 similar to the first ending portion 24. Preferably, each of the first and second ending portions 24, 28 of the sides of the first pair 14 is a substantially straight segment. It should be mentioned that the first ending portion 24, the split deviation 20, which comprises the generally straight segment 26, and the second ending portion 28 of the sides of the first pair 14 may be different from those of the sides of the second and third pairs 16, 18. They however bear the same reference numerals for facilitating the reference to the Figures. As shown, each side of a corresponding pair is adjacent to a corresponding side of each of the remaining pairs. According to the illustrated preferred embodiment, from a general point of view, each side is advantageously rotationally spaced from adjacent sides by an angle of 120°. More specifically, each ending portion 24, 28 of each side is rotationally spaced from the adjacent ending portion 24, 26 of the adjacent side by an angle of 120°. Of course, other configurations could be envisaged.

Referring now to FIGS. 1 and 4, in order to improve even more the natural look of the pavement, each of the sides advantageously has a chiselled upper edge 30. Moreover, the artificial covering unit 10 is advantageously provided with a top face 32 having a texture that imitates a natural covering unit, such as a natural flagstone. Furthermore, as illustrated, in the preferred embodiment of the invention, the top face 32 has deep joints 34 dividing the top face 32 into smaller top sections 36. The deep joints 34 preferably extend through a portion of the height of the covering unit 10, so that when the unit is laid out, it gives the visual impression of an arrangement of smaller unit, while still retaining the advantages of handling only a larger block. In the embodiment illustrated in FIG. 1, the deep joints 34 separate the covering unit 10 into four sections 36 of various shapes and sizes. Of course, the covering unit 10 can be provided with any number of deep joints 34 of any shape which define any number of sections 36.

In another aspect of this embodiment, the covering unit 10 may be breakable along the deep joints 34. This allows breaking off one or more of the unit sections 36 while still render possible a matingly engagement of the broken covering unit with other ones.

Referring again to FIG. 1 and also to FIGS. 3B to 3E, according to a preferred embodiment of the invention, the body 12 of the covering unit 10 is advantageously divided into a bottom part 38 devised to contact the surface to cover and an upper part 40 topping the bottom part 38, the upper part 40 having a contour line generally similar to the bottom part and a surface area smaller than the surface area of the bottom part whereby spaces 42 are created between the upper parts 40 of adjacent covering units 10 covering a surface. This preferred embodiment of the covering unit 10 improves even more the random look of the pavement, as shown in FIG. 2.

Referring now to FIGS. 6A to 6E which show one other preferred embodiments of the present invention, the unit 10 may be provided with a plurality of spacers 44 distributed along the sides of the unit 10, whereby in use in combination with the other covering units 10, the spacers 44 define water drainage channels around the unit 10. Preferably, each of the spacers 44 has a thin plate-shaped member 46 protruding from the corresponding side. More preferably, each of the spacers 44 is arranged on a corresponding vertex 48 of the hexagonal body 12. It should however be mentioned that other arrangements could also be considered.

Referring again to FIG. 4, there is shown a pavement obtained with six covering units 10 of the present invention. As it can be seen, each covering unit 10 can be laid out in one of two orientations on an individual basis.

It is worth mentioning that a plurality of different deep joint configurations may be provided. In this case, the covering units 10 are still easy to install since they still have the same generally hexagonal body 12. However, the visual appearance of the pavement is more natural. It can be easily understood from the above, that a single module is sufficient to create a multitude of different designs. There is no need to use different shapes of covering unit to obtain the sought after natural look. Also, as previously mentioned, the split deviations provided on at least four of the six sides provide an irregular profile that gives the flagstone a more natural look.

From the above, it can easily be understood that the artificial covering unit according to the present invention can advantageously be used for creating patio, pathways, sidewalks or stepping stones for non-limitative examples. Moreover, the covering unit of the present invention can advantageously be easily laid out to form a pavement or a wall surface where no straight lines and hardly any repetition can be seen, giving as a result, the look of old world craftsmanship. Indeed, the installation of the units in staggered rows advantageously reduces the linear line effect compared to an installation in conventional lines. Furthermore, it will be appreciated that all of the covering unit of a pavement can be the same, but still create a visually "random" effect in which no straight lines can be seen.

Preferably, the top face 32 of the covering units 10 has several regions of the same height, thereby facilitating stacking of the covering units.

The artificial covering unit according to the present invention has several advantages over prior art products. Indeed, its installation is very easy, does not require distinctive markers for guiding the installation, and does not require professional skills. The resulting pavement has no "linear effect", that is, a person walking thereon would not see any straight line in front of him or her. It has a random look, achieved with a single stone design.

One advantage also over the flagstone described in Canadian patent No. 2,569,998 is that the covering unit according to the invention makes it easier to build an alley or sidewalk thanks to the fact that the covering unit has an angular symmetry of 180° about its central point.

The artificial covering unit of the present invention is also very advantageous for a manufacturer, since the production of the covering units requires only a single shape for the mould used for moulding the covering units.

Although preferred embodiments of the present invention have been described in detail herein and illustrated in the accompanying drawings, it is to be understood that the invention is not limited to these precise embodiments and that various changes and modifications may be effected therein without departing from the scope of the present invention.

The invention claimed is:

1. A covering unit for use in combination with other ones of said covering units for covering a surface, the covering unit having a generally hexagonal body comprising:

a first, a second and a third pair of opposed and substantially parallel sides for defining said generally hexagonal body;

wherein:

each of said sides of each of said pairs has a central point of angular symmetry; and the sides of the second and third pairs are provided with at least one split deviation, at least one projecting portion, and at least one recessed portion along their length, wherein the at least one split deviation, the at least one projecting portion, and the at least one recessed portion are arranged so that each side of said second pair is a rotational image of the sides of said third pair, whereby in use in combination with said other covering units, said covering unit has a central point of angular symmetry and is matingly engageable with a plurality of neighbouring covering units in either a similar orientation or in an orientation of 180°.

2. The covering unit of claim 1, wherein the sides of the first pair have a length substantially longer than a length of the sides of the second and third pairs.

3. The covering unit of claim 1, wherein the sides of the first pair are provided with at least one split deviation along their length arranged so that each side of said first pair is a rotational image of the other one.

4. The covering unit of claim 1, wherein said covering unit is engageable with the plurality of neighbouring covering units in staggered rows.

5. The covering unit of claim 1, wherein each side is rotationally spaced from adjacent sides by an angle of substantially 120°.

6. The covering unit of claim 3, wherein the sides of the first pair are provided with at least one projecting portion and at least one recessed portion separated by the at least one split deviation along their length.

7. The covering unit of claim 1, the covering unit being an artificial flagstone.

8. The covering unit of claim 1, wherein the generally hexagonal body of the covering unit is divided into a bottom part configured to contact the surface to be covered and an upper part positioned above the bottom part, wherein the upper part comprises an outer contour shape that is similar in appearance to an outer contour shape of the bottom part, and wherein the upper part comprises a surface area that is smaller than a surface area of the bottom part, whereby spaces are created between the upper parts of adjacent covering units covering the surface.

9. The covering unit of claim 1, wherein a top face of the generally hexagonal body comprises deep joints extending through at least a portion of the upper portion, wherein the deep joints divide the top face into smaller top sections.

10. A covering unit for use in combination with other ones of said covering units for covering a surface, the covering unit having a generally hexagonal body comprising:

a first, a second and a third pair of opposed and substantially parallel sides for defining said generally hexagonal body;

wherein:

the second and third pairs of sides are substantially similar to each other while the first pair of sides is substantially longer and different from the second and third pairs of sides; and the sides of the second and third pairs are provided with at least one split deviation, at least one projecting portion, and at least one recessed portion along their length, wherein the at least one split deviation, the at least one projecting portion, and the at least one recessed portion are arranged so that each side of said second pair is a rotational image of the sides of said third pair, whereby in use in combination with said other covering units each one of said sides is matingly engageable with the sides of an equivalent pair of sides of a neighbouring covering unit.

11. The covering unit of claim 10, wherein the sides of the first pair are provided with at least one split deviation along their length arranged so that each side of said first pair is a rotational image of the other one.

12. The covering unit of claim 10, wherein each side is rotationally spaced from adjacent sides by an angle of substantially 120°.

13. The covering unit of claim 11, wherein the sides of the first pair are provided with at least one projecting portion and at least one recessed portion separated by the at least one split deviation along their length.

14. The covering unit of claim 10, the covering unit being an artificial flagstone.

15. The covering unit of claim 10, wherein the generally hexagonal body of the covering unit is divided into a bottom part configured to contact the surface to be covered and an upper part positioned above the bottom part, wherein the upper part comprises an outer contour shape that is similar to an outer contour shape of the bottom part, and wherein the upper part comprises a surface area that is smaller than a surface area of the bottom part, whereby spaces are created between the upper parts of adjacent covering units covering the surface.

16. The covering unit of claim 10, wherein a top face of the generally hexagonal body comprises deep joints extending through at least a portion of the upper portion, wherein the deep joints divide the top face into smaller top sections.

17. A covering unit for use in combination with other ones of said covering units for covering a surface, the covering unit having a generally hexagonal body comprising:

a top face comprising a plurality of joints dividing the top face into smaller top sections;

a bottom face positioned below the top face;

a first, a second and a third pair of opposed and substantially parallel sides for defining said generally hexagonal body;

wherein:

each of said sides of each of said pairs has a central point of angular symmetry;

the second and third pairs of sides are substantially similar to each other while the first pair of sides is substantially different from the second and third pairs of sides; and the sides of the first, second, and third pairs are provided with at least one split deviation, at least one projecting portion, and at least one recessed portion along their length, wherein the at least one split deviation, the at least one projecting portion, and the at least one recessed portion are arranged so that each side of said first pair is a rotational image of the other one, and each side of said second pair is a rotational image of the sides of said third pair, wherein the top face comprises an outer contour shape that is similar in appearance to an outer contour shape of the bottom face, and wherein the top face comprises a surface area that is smaller than a surface area of the bottom face, whereby spaces are created in the top face by the plurality of joints dividing the top face into smaller top sections.

18. The covering unit of claim 17, wherein the sides of the first pair have a length substantially longer than a length of the sides of the second and third pairs.

19. The covering unit of claim 17, wherein each side is rotationally spaced from adjacent sides by an angle of substantially 120°.

20. The covering unit of claim 17, the covering unit being an artificial flagstone.

* * * * *